US006755129B2

(12) United States Patent
Schneider et al.

(10) Patent No.: US 6,755,129 B2
(45) Date of Patent: Jun. 29, 2004

(54) METHOD OF PRINTING UNIQUE PRINTS OR INDIVIDUALLY ASSEMBLED PRINTED PRODUCTS ON ROTARY PRINTING MACHINES

(75) Inventors: Josef Schneider, Diedorf (DE); Alfons Schuster, Augsburg (DE); Horst Dauer, Rohrbach (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/233,649

(22) Filed: Sep. 3, 2002

(65) Prior Publication Data

US 2003/0041764 A1 Mar. 6, 2003

(30) Foreign Application Priority Data

Sep. 3, 2001 (DE) ..... 101 43 119

(51) Int. Cl.[7] ..... B41L 19/00
(52) U.S. Cl. ..... 101/483; 101/76; 101/92
(58) Field of Search ..... 101/483, 91, 95, 101/72, 76; 270/1.01, 18

(56) References Cited

U.S. PATENT DOCUMENTS 3,421,752 A * 1/1969 Folino ..... 270/1.02
3,844,210 A * 10/1974 Allais ..... 101/102
3,998,446 A * 12/1976 Dent ..... 270/18
4,368,281 A * 1/1983 Brummett et al. ..... 523/458
4,368,665 A 1/1983 Boyle ..... 101/93.01
4,601,239 A * 7/1986 Sillars ..... 101/76
5,020,434 A * 6/1991 Copham ..... 101/485
5,489,091 A * 2/1996 Greer et al. ..... 270/1.01
5,535,677 A * 7/1996 Fannin et al. ..... 101/486
5,656,081 A * 8/1997 Isen et al. ..... 118/46

FOREIGN PATENT DOCUMENTS

DE 199 16 781 10/2000 ..... G06K/19/077
EP 1 132 204 9/2001 ..... B41F/13/50

* cited by examiner

*Primary Examiner*—Daniel J. Colilla
*Assistant Examiner*—Jill E. Culler
(74) *Attorney, Agent, or Firm*—Cohen, Pontani, Lieberman & Pavane

(57) ABSTRACT

The image subject to be transferred is applied in preformatted form to at least two printing formes in the form of segment-like image data in a row and column arrangement, in such a way that a first portion of information from each segment of the image subject (information (a) with appropriate index features) is provided on a first printing forme, and a second portion of information from the corresponding segment of the image subject (information (b) with appropriate index features) is provided on a second printing forme. As a result of synchronous rolling of the printing-forme cylinders, the portions of information are assembled to form complete information (<a,b> with the respectively combined index features) for each segment of the image subject on the printed page. For each printing-forme cylinder revolution, the index features for each segment of the image subject (information <a,b>) are recombined step by step in the manner of a permutation, so that each printed segment constitutes a unique print.

8 Claims, 2 Drawing Sheets

Printing forme 1

| | | | | |
|---|---|---|---|---|
| <1,1>( ) | <1,2>( ) | <1,3>( ) | | <1,n>( ) |
| <2,1>( ) | <2,2>( ) | <2,3>( ) | | <2,n>( ) |
| <3,1>( ) | <3,2>( ) | <3,3>( ) | | <3,n>( ) |
| | | <i,k>( ) | | |
| <m,1>( ) | <m,2>( ) | <m,3>( ) | | <m,n>( ) |

Printing forme 2

| | | | | |
|---|---|---|---|---|
| < >(1) | < >(1) | < >(1) | | < >(1) |
| < >(2) | < >(2) | < >(2) | | < >(2) |
| < >(3) | < >(3) | < >(3) | | < >(3) |
| | | | | |
| < >(j) | < >(j) | < >(j) | | < >(j) |

With $j,m,n \in N$, $j \neq m$. (natural numbers, j not equal to m)

In the present exemplary embodiment: $j = 1,2,\ldots,m+1$

Printing forme 1 FIG. 1A

| | | | | |
|---|---|---|---|---|
| <1,1>( ) | <1,2>( ) | <1,3>( ) | | <1,n>( ) |
| <2,1>( ) | <2,2>( ) | <2,3>( ) | | <2,n>( ) |
| <3,1>( ) | <3,2>( ) | <3,3>( ) | | <3,n>( ) |
| | | <i,k>( ) | | |
| <m,1>( ) | <m,2>( ) | <m,3>( ) | | <m,n>( ) |

Printing forme 2 FIG. 1B

| | | | | |
|---|---|---|---|---|
| < >(1) | < >(1) | < >(1) | | < >(1) |
| < >(2) | < >(2) | < >(2) | | < >(2) |
| < >(3) | < >(3) | < >(3) | | < >(3) |
| | | | | |
| < >(j) | < >(j) | < >(j) | | < >(j) |

With $j,m,n \in N$, $j \neq m$. (natural numbers, j not equal to m)

In the present exemplary embodiment: $j = 1,2,\ldots,m+1$

Result on the printed page

1st cylinder revolution FIG. 2A

| | | | | |
|---|---|---|---|---|
| <1,1>(1) | <1,2>(1) | <1,3>(1) | | <1,n>(1) |
| <2,1>(2) | <2,2>(2) | <2,3>(2) | | <2,n>(2) |
| <3,1>(3) | <3,2>(3) | <3,3>(3) | | <3,n>(3) |
| | | | | |
| <m,1>(m) | <m,2>(m) | <m,3>(m) | | <m,n>(m) |

2nd cylinder revolution FIG. 2B

| | | | | |
|---|---|---|---|---|
| <1,1>(m+1) | <1,2>(m+1) | <1,3>(m+1) | | <1,n>(m+1) |
| <2,1>(1) | <2,2>(1) | <2,3>(1) | | <2,n>(1) |
| <3,1>(2) | <3,2>(2) | <3,3>(2) | | <3,n>(2) |
| | | | | |
| <m,1>(m-1) | <m,2>(m-1) | <m,3>(m-1) | | <m,n>(m-1) |

3rd revolution FIG. 2C

| | | | | |
|---|---|---|---|---|
| <1,1>(m) | <1,2>(m) | <1,3>(m) | | <1,n>(m) |
| <2,1>(m+1) | <2,2>(m+1) | <2,3>(m+1) | | <2,n>(m+1) |
| <3,1>(1) | <3,2>(1) | <3,3>(1) | | <3,n>(1) |
| | | | | |
| <m,1>(m-2) | <m,1>(m-2) | <m,1>(m-2) | | <m,n>(m-2) |

and so on.

METHOD OF PRINTING UNIQUE PRINTS OR INDIVIDUALLY ASSEMBLED PRINTED PRODUCTS ON ROTARY PRINTING MACHINES

BACKGROUND OF THE INVENTION

1. Field of the Invention

The invention relates to the field of conventional printing on a rotary printing machine (for example offset, gravure, flexo or screen printing) and relates to a method of printing unique prints or individually assembled printed products on rotary printing machines by using a plurality of printing forme cylinders.

2. Description of the Related Art

As is known, by means of the digital printing machines, text passages, graphics and images can be interchanged during each cylinder revolution, provided appropriate regions have been predefined on such pages. This can be implemented in conjunction with various templates (pre-prepared configuration patterns with text predefinitions) or by means of the page-by-page restructuring of entire documents, so that quite specific tailor-made printed products are produced, whose individual copies no longer have anything at all in common with one another with regard to information content and appearance. In this sense, a plurality of data streams, that is to say at least two, are brought together. These can consist, for example, firstly of repeated and secondly of one-off page elements. The elements used many times are pre-processed in a raster image processor in modern workflows, are stored and called up as required as a bitmap. The variable data are supplied from databases to a so-called RIP/front end. The databases which are used play a rather subordinate role, since their contents must in any case be present in a format that can be processed by the printing system or must be converted. Because of these technical possibilities, digital printing is also referred to as dynamic printing in the trade.

Variant printing or unique printing has previously only been possible with electronic, that is to say digital, printing processes (laser/inkjet/thermal transfer). "Image one—print one" therefore requires direct imagesetting from a stock of data for each unique print, for example in the case of electrophotographic, thermographic or inkjet systems. The advantage resides precisely in the fact that the data can be varied for each print—for example in order to produce barcodes on price tickets, numbering systems or else individualized flight tickets, etc.

The increasing trend towards a desire for distinguishability, that is to say individualization, cannot currently be satisfied in productive conventional printing (for example offset, gravure, flexo or screen printing) (all copies are identical). This has previously been the deficiency of conventional or therefore also of "static" printing which, because of its cost structure, is rather more aligned to mass duplication. "Image one—print many" means setting an image on a plate or a writeable cylinder for the production of a plurality of identical printed copies. The image setting itself can quite possibly be brought about digitally by means of "computer-to-film" (including the production of a digitally output film with the possibility of also continuing to print conventionally) or "computer-to-plate" (that is to say a process for exposing a printing image directly onto the printing forme or plate) or "computer-to-press" (the process requires neither film nor plate, as described for example in DE 199 39 240 A1 and U.S. Pat. No. 6,070,528. However, the printing speed of conventional printing is comparatively very high and complicated front-end systems, which the use of variable data makes necessary, are not an issue.

In the case of conventional printing, the printing unit, as a central subassembly of each rotary printing machine, performs the function of transferring the printing image from the printing forme on the printing-forme cylinder (via the rubber blanket in the case of offset printing) to the printing material. Examples of familiar printing-unit formes are the 3-cylinder system for each printing unit for the single-color printing of a printing material, or the 4-cylinder system for a so-called double printing unit for printing both sides of a printing material, or a 6-cylinder system, in which for each printing unit, a printing material is led between two blanket cylinders and printed in 2/1 colors, that is to say two systems of rubber blanket printing-forme cylinder are arranged on a blanket cylinder for each printing unit. As is known, rotary printing machines print from cylindrical printing formes, so that printing forme and impression cylinder in each printing unit roll continuously and in each case synchronized with each other. Rotary printing machines are used both for relief and for gravure and offset printing, their construction, in particular the number of printing units, of course depending on the process used. Furthermore, the variation in the printing units when conceiving a printing machine is very wide and, by means of an aggregate or modular method, can be differentiated in accordance with the envisaged production profile.

SUMMARY OF THE INVENTION

It is therefore an object of the present invention to propose a method for printing unique prints or individually assembled printed products on rotary printing machines which can be used for conventional printing (offset, gravure printing, and so on).

The invention relates to a method of printing unique prints or individually assembled printed products on rotary printing machines by using a plurality of printing-forme cylinders. According to the invention, the image subject to be transferred is applied in preformatted form to at least two printing formes in the form of segment-like image data preferably in a row and column arrangement, in such a way that a first portion of information from each segment of the image subject (information (a) with appropriate index features) is provided on a first printing forme, and a second portion of information from the corresponding segment of the image subject (information (b) with appropriate index features) is provided on a second printing forme. As a result of synchronous rolling of the printing-forme cylinders, the portions of information are assembled to form complete information (<a,b> with the respectively combined index features) for each segment of the image subject on the printed page. For each printing-forme cylinder revolution, the index features for each segment of the image subject (information <a,b>) are recombined step by step in the manner of a permutation, so that each printed segment constitutes a unique print. Apart from familiar unique subjects such as barcodes and numbers comprising preformatted data sets, even the printing of individual polymer electronics, that is to say the production of individual electronic patterns by imprinting, for example, links which close the circuit bit by bit, suitably polarized diodes or other semi-conductors or suitably designed feed lines for respectively identical electronics is feasible.

The production of transponder chips (response devices), which can be written and read by means of appropriate electronics, is widely known (see, for example, U.S. Pat. No. 5,826,175 or EP 1 079 397 A1). As electronics which can be produced comparatively cheaply, polymers with a certain conductivity have already become known, and by means of these polymers, conductors, insulators and semiconductors can be produced. Polymer conductors, insulators and semiconductors are therefore available nowadays (as indicated, for example, by EP 1 079 397 A1), but attractively priced processes for the mass production of such polymer electronics (for example radio tags) have hitherto not been known. This is the starting point for the present invention. Substrates and materials permit cheap production by means of printing with the method according to the present invention, so that an inexpensive combination of individuality and mass production can be offered.

The fact that for each revolution of the printing-forme cylinder, the index features for each segment of the image subject (information <a,b>) are recombined step by step in the manner of a permutation, so that each printed segment of a production constitutes a unique print, means that precisely individual links preformatted segment by segment, which close the circuit of an electric structure bit by bit, can be printed on, or diodes or else semiconductors or suitably designed feedlines for a constantly repeating electric pattern (for example a basic pattern of a transponder or radio tag) can be printed in.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

FIG. 1A is a table showing the matrix of index features on the first printing forme and place markers for the information segments on the second printing forme;

FIG. 1B is a table showing the matrix of information segments on the second printing forme and place markers for the index features on the first printing forme; and FIGS. 2A, 2B, and 2C are tables showing the matrices of information segments as transferred to printing material during the first, second, and third revolutions.

DETAILED DESCRIPTION OF THE PRESENTLY PREFERRED EMBODIMENTS

In a first exemplary embodiment of the method according to the invention, provision is made for at least two printing-forme cylinders with different circumferences to be used, in such a way that the first printing forme is produced from portions of information (ask) in an $A_{(m,n)}$ matrix arrangement with the line number i=1,2, . . . ,m and the column number k=1,2, . . . ,n, and the second printing forme is produced from portions of information ($b_{jk}$) in a $B_{(m+1,n)}$ matrix arrangement with the line number j=1,2, . . . ,m+1 and the column number k=1,2, . . . ,n so that during the transfer of the printing image from both printing formes to the printing material, the portions of information are combined with each other in such a way that during each revolution of the printing-forme cylinders in each case one segment comprising the element ($a_{ik}$) and an element ($B_{jk}$) changed by at least one line number j is printed, until after m+1 printing-forme cylinder revolutions, production is completed. This can be implemented, for example, in two printing units each having differently prefonnatted printing formes. Printing forme 1 bears m*n different index features distributed in a matrix arrangement over its circumferential surface and, adjacent to the these features, in each case a place-marker ( ) for the information from printing forme 2 (in FIG. 1A: "Printing forme 1" is identified by <m,n> and ( ) for the segment-by-segment information ($a_{ik}$)). At the positions j corresponding to the place-markers of printing forme 1 of printing forme 1, printing forme 2 bears information segments which are arranged in columns in the circumferential direction but are identical line by line (which, of course, can also have any desired information content) and, at the positions corresponding to the index features from printing forme 1, place-markers <> (in FIG. 1B: "Printing forme 2" is identified by < > (j) for the information ($b_{jk}$)). The index feature used can be a barcode, a number combination or an item of structure information for electronic circuits in any desired combination. Optionally, a fixed feature can be appended to each matrix cell or segment, being used for example to distinguish between the productions (batch numbers), and provides a memory function (no matter on which cylinder). In order to distinguish between the productions, this feature can be a barcode, a number combination or an item of structure information for electronic circuits (also including a transfer function) in any desired combination. As a memory function, only one item of structure information can be used. The printing formes transfer their preformatting to the printing material in such a way that the combination <a,b> of the preformatting shown in FIGS. 2A, 2B, and 2C is produced on the printing material.

The size per individual, that is to say unique print (b=width, h=height) is given by the size of the structures used, that is to say the segments. The printing width of both printing formes 1 and 2 is B=n*b, the circumference of printing forme 1 is U1=m*h, the circumference of printing forme 2 is U2=j*h, that is to say=(m+1)*h. The values for B, U1 and U2 are to be set as usual in the printing sector (B=0.5 to 1.5 m, U1 and U2=0.5 to 1.5 m). The values for b, h (structure or segment size) typically lie between 1 mm and 5 cm, depending on the combination, but of course very much smaller or greater values for b, h can be implemented.

Example: For B=1 m, U1=1 m and b=h=1 cm, for example, m=n=1,2, . . . ,100 and there are 10 000 segments on the printing forme 1. Now let U2=1.01 m and therefore j=1,2, . . . ,101, that is to say there are 101 lines on the printing forme 2. During printing, both cylinders transfer their preformatted information to the printing material in a manner following the path accurately, so that the sequence of indexed features sketched in FIGS. 2A, 2B, and 2C is produced. Following 101 revolutions of printing forme 1 and, respectively, 100 revolutions of printing forme 2, production is complete. 1 010 000 unique prints have been printed.

In general, m*n*j unique prints can be printed by means of the combination of the preformatting (without changing over). If j≠m, U1≠U2, printing forme 1 and 2 have different speeds of rotation but the same surface speeds. This is implemented, for example, by means of individually driven printing units or cylinders.

In the second exemplary embodiment of the method according to the invention, provision is made that, when printing-forme cylinders with identical circumferences are used, the first printing forme is produced from portions of information ($a_{ik}$) in an $A(_{m,n})$ matrix arrangement with the line number i=1,2, . . . ,m and the column number k=1,2, . . . ,n, the second printing forme is produced from portions of information ($b_{ik}$) in a $B(_{m,n})$ matrix arrangement with the line number i=1,2, . . . ,m and the column number k=1,2, . . . ,n, then after each revolution of the printing-forme cylinders, one of the printing-forme cylinders is rotated step by step by means of an individual drive by one matrix element height in circumference, so that during the transfer of the printing image from both printing formes to the printing material, the matrix elements ($a_{ik}$) and ($b_{ik}$) are combined with one another in such a way that during each revolution of the printing-forme cylinders in each case one segment comprising the element ($a_{ik}$) and an element ($b_{ik}$) changed by at least one line number i is printed, until after m printing-forme cylinder revolutions and m-1 step-by-step rotations of one of the printing-forme cylinders, production is completed. Therefore, j=m and U1=U2 are selected and, via individual drives, a type of "stepped operation" is possible, in which, following each revolution of, for example, printing forme 1, just printing forme 2, or vice versa is rotated by one structure or segment height h in the circumferential register (if necessary, with intermittently reduced pressure).

A higher level of individualization can be carried out in an analogous manner by means of further printing units.

The individualization can also be combined with conventional printing applications (in order for example to print intelligent packages), by only the subset of the set needed for the current copy being used. The unnecessary parts can be inactivated or destroyed, for example electronically, or made unusable by being bridged with conductive ink.

Alternatively, it is possible to make contact only with the necessary parts or to provide them with an antenna.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A method of printing unique prints or individually assembled printed products on rotary printing machines, said method comprising providing an image subject to be transferred to a printing material in the form of preformatted data, said data comprising a plurality of segments in a line and column format, each segment having a width b and a height h, each segment comprising a first portion and a second portion, each portion comprising an index feature, providing said first portion of each said segment on a first printing forme cylinder in a line and column format, having i lines and n columns, said first printing form having a printing width B=n*b, providing said second portion of each said segment on a second printing forme cylinder in a line and column format, having j lines and n columns, said first printing form having a printing width B=n*b, synchronously rolling said first and second printing forme cylinders so that said first and second portions of data are transferred to the printing material and so that each first portion is assembled with a respective second portion to form a complete segment of data, and for each revolution of said printing forme cylinders, recombining said index features of each said segment stepwise in the manner of a permutation so that said printing material is uniquely printed with each said revolution and so that i*j*n unique prints can be printed by combining preformatted data without changing the preformatting.

2. A method of printing unique prints as in claim 1 comprising providing said first portions ($a_{ik}$) of data on said first printing forme cylinder in an $A_{(m,n)}$ matrix arrangement with line numbering i=1,2, . . . ,m and column numbering k=1,2, . . . ,n, providing said second portions ($b_{jk}$) of data on said second printing forme cylinder in a $B_{(m+1,n)}$ matrix arrangement with line numbering j=1,2, . . . ,m+1 and column numbering k=1,2, . . . ,n, and providing said first and second forme cylinders with different circumferences so that, during the transfer of data from said first and second forme cylinders to said printed material, during each revolution of the printing forme cylinders, in each segment the first portion ($a_{ik}$) and the second portion ($b_{jk}$) changed by at least one line number j is printed, until after m+1 revolutions, production is completed.

3. A method of printing unique prints as in claim 1 comprising providing said first portions ($a_{ik}$) of data on said first printing forme cylinder in an A(m,n) matrix arrangement with line numbering i=1,2, . . . ,m and column numbering k=1,2, . . . ,n, providing said second portions ($b_{jk}$) of data on said second printing forme cylinder in a $B_{(m,n)}$ matrix arrangement with line numbering j=1,2, . . . ,m and column numbering k=1,2, . . . ,n, providing said first and second forme cylinders with identical circumferences, and after each revolution of the printing forme cylinders, rotating one of said cylinders with respect to the other one of said cylinders stepwise so that, during the transfer of data from said first and second forme cylinders to said printed material, during each revolution of the printing forme cylinders, in each segment the first portion ($a_{ik}$) and the second portion ($b_{ik}$) changed by at least one line number i is printed, until after m revolutions and m−1 stepwise rotations, production is completed.

4. A method of printing unique prints as in claim 1 wherein each of said portions further comprises a barcode, each of said segments comprising a barcode from each of said portions printed over the index feature of the other of said portions.

5. A method of printing unique prints as in claim 1 wherein each of said portions further comprises a number combination, each of said segments comprising a number combination from each of said portions printed over the index feature of the other of said portions in order to produce individual labels.

6. A method of printing unique prints as in claim 1 wherein each of said portions further comprises one of an electrically conductive and an insulating pattern, each of said segments comprising one of an electrically conductive and an insulating pattern from each of said portions printed over the index feature of the other of said portions in order to produce individual circuits.

7. A method of printing unique prints as in claim 1 wherein each of said portions further comprises one of individual polymer conductors, insulators, and semiconductors, each of said segments comprising one of individual polymer conductors, insulators, and semiconductors from each of said portions printed over the index feature of the other of said portions in order to produce individual polymer electronics.

8. A method of printing unique prints as in claim 1 further comprising at least a third printing forme cylinder, each segment comprising at least a third portion of data provided on a respective said at least a third printing forme cylinder, whereby the level of individualization of individual segments is increased.

* * * * *